US005932837A

United States Patent [19]

Rusek et al.

[11] Patent Number: 5,932,837

[45] Date of Patent: Aug. 3, 1999

[54] NON-TOXIC HYPERGOLIC MISCIBLE BIPROPELLANT

[75] Inventors: John J. Rusek, North Edwards; Nicole Anderson, Ridgecrest; Bradley M. Lormand, Grover Beach; Nicky L. Purcell, Ridgecrest, all of Calif.

[73] Assignee: The United States of America as represented by the Secretary of the Navy, Washington, D.C.

[21] Appl. No.: 08/999,059

[22] Filed: Dec. 22, 1997

[51] Int. Cl.[6] ..... C06B 47/02

[52] U.S. Cl. ..... 149/1; 149/45; 149/108.6; 60/211; 60/212

[58] Field of Search ..... 149/1, 45, 108.6; 60/211, 212

[56] References Cited

U.S. PATENT DOCUMENTS

| | | | |
|---|---|---|---|
| 2,835,106 | 5/1958 | Carter | 149/108.6 |
| 2,874,535 | 2/1959 | Ayers et al. | 60/211 |
| 2,896,407 | 7/1959 | Zletz et al. | 60/211 |
| 3,082,598 | 3/1963 | Mahan | 149/1 |
| 3,142,151 | 7/1964 | Roberts et al. | 149/1 |
| 3,700,393 | 10/1972 | Mueller | 149/75 |
| 4,316,359 | 2/1982 | Sayles | 60/212 |
| 4,698,965 | 10/1987 | Delchev et al. | 149/1 |
| 5,397,399 | 3/1995 | Lownds | 149/109.6 |
| 5,854,061 | 12/1998 | Horn et al. | 435/262.5 |

*Primary Examiner*—Edward A. Miller
*Attorney, Agent, or Firm*—Gregory M. Bokar; David S. Kalmbaugh

[57] ABSTRACT

The non-toxic bipropellent of the present invention contains a non-toxic hypergolic miscible fuel (NHMF) and a rocket grade hydrogen peroxide. This non-toxic hypergolic miscible fuel (NHMF) has rapid ignition capability. The non-toxic hypergolic miscible fuel (NHMF) contains 3 species. Namely, a polar organic species miscible with hydrogen peroxide, a propagator, which may be substituted or unsubstituted amines, amides or diamines, and an inorganic metal salt, which reacts to form a catalyst in solution or as a colloid. The inorganic metal salt is miscible with the polar organic species and the propagator in solution. The catalyst has a faster rate of reaction with said rocket grade hydrogen peroxide than the propagator, the propagator has a faster rate of reaction with the rocket grade hydrogen peroxide than the polar organic species, and the polar organic species, propagator and catalyst are mutually soluble.

13 Claims, No Drawings

NON-TOXIC HYPERGOLIC MISCIBLE BIPROPELLANT

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefore.

MICROFICHE APPENDIX

Not Applicable.

BACKGROUND OF THE INVENTION

1. Field of the Invention

The present invention relates in general to a non-toxic hypergolic bipropellent and, more particularly, to a non-toxic bipropellent which contains a non-toxic hypergolic miscible fuel and a rocket grade hydrogen peroxide oxidizer. The non-toxic hypergolic miscible fuel contains a polar organic species, a propagator and an inorganic metal salt which reacts to form a catalyst in solution.

2. Description of the Prior Art

Innovative propellants have long been used by the United States Navy for power generation, propulsion and ordnance. Prime considerations in the post World War II era have been specific impulse, volumetric energy content, surge/mobilization readiness and shipboard safety. While these parameters are still important, environmental concerns, commercial transitions and cost have been added to the list of considerations to be taken into account.

Traditional power generation systems include hydrazine monopropellant actuators, storable hypergolic thrusters using monomethyl hydrazine/nitrogen tetroxide, and propulsion devices using halogen-containing solid propellants. These systems all pose significant environmental problems and have high associated costs. Alternatively, traditional hypergolic bipropellants have been used, but have proved to be carcinogenic and toxic, as well as difficult and dangerous to manufacture.

In the past, hydrogen peroxide, as well as polar organic species such as alcohols have been used as components of bipropellants, mainly for rockets. However, inorganic contaminants in the hydrogen peroxide yielded an inadequate maximum upper concentration limit of hydrogen peroxide which could be safely and effectively used in the bipropellant. Addition of hydrogen peroxide above these concentration limits created an unstable bipropellant system, both in usage and in storage.

When using traditional high strength hydrogen peroxides, long term containment, safe/practical enrichment and controlled catalytic decomposition problems have occurred. Hydrogen peroxide stored in non-vented metallic containers posed a formidable problem, due to unplanned catalytic decomposition. In addition, traditional distillation technology yielded 90% hydrogen peroxide. Above 90%, the hydrogen peroxide vapors are detonable at the conditions of the distillation. Fractional crystallization is also a difficult separation technique due to water occlusion in hydrogen peroxide crystals.

These technical problems were overcome by massive defense spending, which allowed for the use of extremely expensive and complex materials. However, with current decreased defense spending, low cost and life cycle waste generation become increasingly important factors in the development and manufacture of defense related products. The use of expensive and complex materials to overcome the above mentioned problems have now become impractical.

BRIEF SUMMARY OF THE INVENTION

It is, therefore, an object of the present invention to provide quickly renewable, hypergols which are non-toxic and form either solutions or true colloids.

It is another object of the present invention to provide a non-toxic hypergolic miscible fuel which can be used in combination with a rocket grade hydrogen peroxide to form a safe, non-toxic miscible bipropellent with rapid ignition capabilities.

It is yet another object of the present invention to provide a non-toxic hypergolic miscible fuel containing an inorganic metal salt, which reacts to form a catalyst in solution. Such a fuel may be used with a rocket grade hydrogen peroxide oxidizer to form a non-toxic miscible bipropellent having hypergolic properties.

The present invention provides a non-toxic bipropellent containing a non-toxic hypergolic miscible fuel (NHMF) and rocket grade hydrogen peroxide oxidizer. The non-toxic hypergolic miscible fuel contains about 50 to 75 weight % polar organic species miscible with hydrogen peroxide, about 0.1 to 15 weight % propagator, and about 0.1 to 30 weight % inorganic metal salts which react to form a catalyst in solution or as a colloid. The polar organic species can be $C_1$ to $C_6$ alcohols and/or $C_1$ to $C_4$ ketones, the propagator can be substituted or unsubstituted amides, amines and diamines, and the inorganic metal salts is selected from the group consisting of manganese, copper, cobalt and iron.

The inorganic metal salts are miscible with the polar organic species and the propagator in solution. The catalyst has a faster rate of reaction with the rocket grade hydrogen peroxide than the propagator, the propagator has a faster rate of reaction with the rocket grade hydrogen peroxide than the polar organic species, and the polar organic species, propagator and catalyst are mutually soluble.

BRIEF DESCRIPTION OF THE SEVERAL VIEWS OF THE DRAWING

Not Applicable.

DETAILED DESCRIPTION OF THE INVENTION

Recently, with new analysis methods, it is possible to precisely determine types and quantities of contaminants present in the hydrogen peroxide. Knowing the types and quantities of contaminants present in the hydrogen peroxide, it is now possible to produce safer, higher concentration hydrogen peroxide for use in a bipropellent.

In view of the new techniques for production of safer, higher concentration hydrogen peroxide, the inventors of the present invention were able to combine their recently discovered novel non-toxic hypergolic miscible fuel (NHMF) with a rocket grade hydrogen peroxide to form the bipropellant of the present invention. This new bipropellent is especially applicable for use in divert/attitude control systems, orbit transfer systems, thrusters, large launch vehicle applications, as well as any motive power engines. Preferably, the rocket grade hydrogen peroxide of the present invention consists of about 85–100 weight % hydrogen peroxide with less than 1.0 mg/l phosphorus, tin or sodium ions.

The non-toxic hypergolic miscible fuel contains 3 species. Namely, a polar organic species or mixture of a polar organic species miscible with hydrogen peroxide, a propagator which is a basic organic species such as substituted or unsubstituted amines, amides or diamines, and inorganic metal salts, which act as a catalyst and are miscible with the polar organic species and the propagator in solution. The inorganic metal salts reacts to form a catalyst in solution.

In a preferred embodiment of the present invention, a nontoxic hypergolic miscible fuel (NHMF) consisting of a catalyst, propagator and polar organic species is obtained by adding an inorganic metal salt as a catalyst into a solution consisting of a propagator and a polar organic species. This mixture is then reacted with a rocket grade hydrogen peroxide acting as the oxidizer (the combination of both being a bipropellant). The bipropellent of the present invention preferably has an oxidizer-to-fuel ratio (O/F ratio) of about 0.5 to 5.0.

The non-toxic hypergolic miscible fuel of the bipropellent consists of 50 to 75 weight % polar organic species miscible with hydrogen peroxide. In the preferred embodiment, $C_1$ to $C_6$ alcohols and $C_1$ to $C_4$ ketones are used as the polar organic species. As the propagator, 0.1 to 15 weight % of amides, substituted diamines, ethylene diamine tetraacetic acid (EDTA) or basic disubstituted EDTA are used.

In a preferred embodiment, the catalyst comprises either hydrated or unhydrated manganese acetate, copper acetate, iron acetate, cobalt acetate, manganese nitrates, copper nitrates, iron nitrates and cobalt nitrates. The catalyst is formed by adding a soluble inorganic metal salt into the solution consisting of the polar organic species and the propagator. When added to the solution, in situ formation of a microdispersed colloidal metal oxide and acetic acid occurs, which act as the catalyst.

In most cases, the catalyst species should have a faster rate of reaction with the rocket grade hydrogen peroxide than the propagator, and the propagator should have a faster rate of reaction with the rocket grade hydrogen peroxide than the polar organic species. In addition, the propagator and catalyst should be mutually soluble.

In another preferred embodiment, 70 to 99 weight % polar organic species and 0.1 to 30 weight % catalyst are mixed to form the NHMF. The polar organic species consists of a lower alcohol such as methanol, ethanol or propanol. The catalyst consists of manganese acetate tetrahydrate. The manganese acetate tetrahydrate reacts when placed into solution with the polar organic species to form a microdispersed colloidal manganese oxide and acetic acid. The acetic acid, produced by the reaction of the manganese acetate tetrahydrate in solution, acts as a propagator.

In this embodiment of the invention, the catalyst should have a faster rate of reaction with the rocket grade hydrogen peroxide than the polar organic species. The oxidizer-to-fuel (O/F) ratio for this embodiment is also preferably about 0.5 to 5.0. More preferred embodiments consist of mixing 50 to 75 weight % methanol, ethanol or propanol as the polar organic species, 0.1 to 30 weight % of either hydrated or unhydrated manganese acetate, copper acetate, cobalt acetate, iron acetate, manganese nitrate, copper nitrate, cobalt nitrate or iron nitrate as the catalyst precursor and 0.1 to 16 weight % urea (carbamide), formamide, acetamide, ethylene diamine tetraacetic acid (EDTA) or basic disubstituted EDTA such as dipotassium ethylene diamine tetraacetic acid ($K_2$EDTA) as the propagator to form a non-toxic hypergolic miscible fuel with rapid ignition capability. Upon mixing of these three ingredients, the catalyst precursor reacts to form a microdispersed colloidal metal oxide and acetic acid. Upon formation of the microdipersed colloidal metal oxide and acetic acid, the non-toxic fuel consists of four compounds (alcohol, microdipersed colloidal metal oxide, acetic acid and propagator species).

An even more preferred embodiment consists of mixing methanol as the polar organic species, manganese acetate tetrahydrate as the catalyst precursor and urea (carbamide). Upon mixing of these three ingredients, the catalyst precursor reacts to form microdispersed colloidal manganese oxide and acetic acid. Upon formation of the microdispersed colloidal manganese oxide and acetic acid, the non-toxic fuel consists of four compounds (methanol, microdispersed colloidal manganese dioxide, acetic acid and urea).

In another even more preferred embodiment, methanol as the polar organic species, manganese acetate tetrahydrate as the catalyst and dipotassium ethylene diamine tetraacetic acid ($K_2$EDTA) as the propagator are mixed to form the non-toxic hypergolic miscible fuel (NHMF).

In a most preferred embodiment of the invention, about 600 g methanol as the organic polar species, about 200 g manganese acetate tetrahydrate as the catalyst and about 90 g urea as the propagator are mixed in solution to form the NHMF.

In another most preferred embodiment, about 7 g methanol as the polar organic species, about 3 g manganese acetate tetrahydrate as the catalyst and about 0.05 g $K_2$EDTA as the propagator are mixed to form the NHMF.

In another preferred embodiment, a mixture of methanol and propargyl alcohol may also be used with the chosen propagator.

In another most preferred embodiment, about 7 g of a 50/50 volume ratio mixture of methanol and propargyl alcohol as the polar organic species, about 3 g manganese acetate as the catalyst and about 0.05 g $K_2$EDTA as the propagator are mixed to form the NHMF.

In yet another most preferred embodiment, about 175 g manganese acetate tetrahydrate as the propagator and about 600 g of methanol as the polar organic species are mixed to form the NHMF. As described earlier, the manganese acetate tetrahydrate reacts in solution to form a microdipersed colloidal manganese oxide and acetic acid. The acetic acid acts as the propagator.

EXAMPLE 1

Methanol, manganese acetate tetrahydrate and $K_2$EDTA were mixed to form a non-toxic hypergolic miscible fuel (NHMF). This fuel was combusted in Tests 1–5 (Table 1) with 95.4 weight % rocketgrade hydrogen peroxide in an open injector rocket engine. Several different oxidizer-to-fuel ratios (O/F ratio) were used, and ignition delays were measured, as set forth in Table 1 below. In all conditions, hypergolicity was demonstrated. Ignition times varied with ratio. These synthesized fuels prepared according to the present invention were found to be truly polar, were non-toxic, economical, and most importantly, had actual hypergolic ignition delays in the millisecond region. These short ignition delays, which are critical to successful rocket engine performance, were demonstrated in all cases.

TABLE 1

| Test # | O/F Ratio | Ignition Delay (ms) |
|---|---|---|
| 1 | 2.5 | 16 |
| 2 | 2 | 23 |
| 3 | 1.6 | 31 |
| 4 | 1.6 | 31 |
| 5 | 3.5 | 14 |

EXAMPLE 2

Methanol, manganese acetate tetrahydrate and $K_2$EDTA were mixed to form a non-toxic hypergolic miscible fuel (NHMF). This fuel was combusted in Tests 6–13 (Table 2) with 98.4 weight % rocketgrade hydrogen peroxide in an open injector rocket engine. Several different oxidizer-to-fuel ratios (O/F ratio) were used, and ignition delays were measured, as set forth in Table 2 below. In all conditions, hypergolicity was demonstrated. Once again, ignition times varied with ratio. As found in Tests 1–5 these synthesized fuels prepared according to the present invention were found to be truly polar, non-toxic, economical, and most importantly, had actual hypergolic ignition delays in the millisecond region. These short ignition delays, which are critical to successful rocket engine performance, were demonstrated in all cases for this mixture as well. However, in all tests using a higher strength rocketgrade hydrogen peroxide, ignition delays were reduced even further.

TABLE 2

| Test # | O/F Ratio | Ignition Delay (ms) |
|---|---|---|
| 6 | 2.5 | 14 |
| 7 | 2 | 14 |
| 8 | 1.6 | 16 |
| 9 | 3 | 18 |
| 10 | 3.5 | 6 |
| 11 | 2.5 | 18 |
| 12 | 2.5 | 15 |
| 13 | 2.5 | 16 |

Since various changes and modifications can be made in the invention without departing from the spirit of the invention, the invention is not to be taken as limited except by the scope of the appended claims.

What is claimed is:

1. A non-toxic bipropellent comprising a non-toxic hypergolic miscible fuel (NHMF) and rocket grade hydrogen peroxide oxidizer, wherein said non-toxic hypergolic miscible fuel comprises:

about 50 to 75 weight % polar organic species miscible with hydrogen peroxide, selected from the group consisting of $C_1$ to $C_6$ alcohols and $C_1$ to $C_4$ ketones;

about 0.1 to 15 weight % propagator selected from the group of basic organic species consisting of substituted or unsubstituted amines, amides and diamines; and about 0.1 to 30 weight % inorganic metal salts which reacts to form a catalyst in solution or a colloid, said inorganic metal salts miscible with said polar organic species and said propagator in solution, said soluble inorganic salt is selected from the group consisting of manganese, copper, cobalt and iron as the metal ion, wherein said catalyst has a faster rate of reaction with said rocket grade hydrogen peroxide than said propagator, said propagator has a faster rate of reaction with said rocket grade hydrogen peroxide than said polar organic species, and said polar organic species, propagator and catalyst are mutually soluble.

2. A non-toxic bipropellent comprising a non-toxic hypergolic miscible fuel (NHMF) and rocket grade hydrogen peroxide oxidizer, wherein said non-toxic hypergolic miscible fuel comprises:

about 70 to 99.9-weight % polar organic species comprising a lower alcohol; and about 0.1 to 30 weight % catalyst comprising manganese acetate tetrahydrate, said manganese acetate tetrahydrate reacting in solution to form microdipersed colloidal manganese oxides and acetic acid, wherein said acetic acid acts as a propagator and said catalyst has a faster rate of reaction with said rocket grade hydrogen peroxide than said polar organic species.

3. The non-toxic bipropellent of claim 1, wherein said polar organic species comprises methanol, ethanol, propanol, propargyl is alcohol or any mixture thereof.

4. The non-toxic bipropellent of claim 2, wherein said polar organic species comprises methanol, ethanol and propanol, propargyl alcohol or any mixture thereof.

5. The-non-toxic bipropellent of claim 1, wherein said propagator is selected from the group consisting of urea (carbamide), formamide, acetamide, ethylene diamine tetraacetic acid (EDTA) and basic substituted EDTA.

6. The non-toxic bipropellent of claim 1, wherein said catalyst is selected from the group consisting of either hydrated or unhydrated manganese acetate, copper acetate, iron acetate, cobalt acetate, manganese nitrates, copper nitrates, iron nitrates and cobalt nitrates.

7. The non-toxic bipropellent of claim 1, wherein said non-toxic bipropellent has an oxidizer-to-fuel ratio in the range of about 0.5 to 5.0.

8. The non-toxic bipropellent of claim 2, wherein said non-toxic bipropellent has an oxidizer-to-fuel ratio in the range of about 0.5 to 5.0.

9. The non-toxic bipropellent of claim 1, wherein said rocket grade hydrogen peroxide comprises about 85–100% by weight hydrogen peroxide and less than about 1.0 mg/l of phosphorus, tin or sodium ions.

10. The non-toxic bipropellent of claim 2, wherein said rocket grade hydrogen peroxide comprises about 85–100% by weight hydrogen peroxide and less than about 1.0 mg/l of phosphorus, tin or sodium ions.

11. The non-toxic bipropellent of claim 3, wherein said propagator is selected from the group consisting of urea (carbamide), formamide, acetamide, ethylene diamine tetraacetic acid (EDTA) and basic substituted EDTA.

12. The non-toxic bipropellent of claim 11, wherein said catalyst is selected from the group consisting of either hydrated or unhydrated manganese acetate, copper acetate, iron acetate, cobalt acetate, manganese nitrates, copper nitrates, iron nitrates is and cobalt nitrates.

13. The non-toxic bipropellent of claim 12, wherein said non-toxic bipropellent has an oxidizer-to-fuel ratio in the range of about 0.5 to 5.0.

* * * * *